US010512335B2

(12) United States Patent
Matsumoto

(10) Patent No.: US 10,512,335 B2
(45) Date of Patent: Dec. 24, 2019

(54) READY-TO-ASSEMBLE CHAIR

(71) Applicant: Grandoir International Ltd., Nagakute-Shi, Aichi (JP)

(72) Inventor: Junya Matsumoto, Nagakute (JP)

(73) Assignee: Grandoir International Ltd., Nagakute-Shi (JP)

( * ) Notice: Subject to any disclaimer, the term of this patent is extended or adjusted under 35 U.S.C. 154(b) by 17 days.

(21) Appl. No.: 15/819,434

(22) Filed: Nov. 21, 2017

(65) Prior Publication Data

US 2018/0084913 A1 Mar. 29, 2018

Related U.S. Application Data

(63) Continuation of application No. PCT/JP2015/064984, filed on May 26, 2015.

(51) Int. Cl.
*A47C 4/02* (2006.01)
*A47D 15/00* (2006.01)
(Continued)

(52) U.S. Cl.
CPC ..... *A47C 4/021* (2013.01); *A47C 4/022* (2013.01); *A47C 4/03* (2013.01); *A47C 4/32* (2013.01); *A47C 4/42* (2013.01); *A47C 7/002* (2013.01); *A47C 7/14* (2013.01); *A47C 13/00* (2013.01); *A47C 16/025* (2013.01); *A47D 1/002* (2013.01); *A47D 1/006* (2013.01); *A47D 1/0081* (2017.05);
(Continued)

(58) Field of Classification Search
CPC ..... A47C 4/021; A47C 3/029; A47C 1/028; A47C 13/00; A47D 1/004; A47D 1/002; A47D 1/04; A47D 15/006; A47D 13/102; A47D 1/006
USPC .... 297/250.1, 256.1, 256.11, 256.12, 256.15
See application file for complete search history.

(56) References Cited

U.S. PATENT DOCUMENTS 2,514,524 A * 7/1950 Steele ..... A47D 1/004 108/146
5,375,869 A * 12/1994 Hsiao ..... A47D 1/02 280/648
2015/0289673 A1* 10/2015 Fine ..... A47D 15/006 297/174 R

FOREIGN PATENT DOCUMENTS

JP 09-065955 3/1997
JP 2006-068498 3/2006
(Continued)

OTHER PUBLICATIONS

International Search Report and Written Opinion (Application No. PCT/JP2015/064984) dated Aug. 18, 2015.

*Primary Examiner* — Justin V Lewis
(74) *Attorney, Agent, or Firm* — Burr & Brown, PLLC

(57) ABSTRACT

The assembly chair includes a pair of frames, a plurality of coupling rods, a plurality of pairs of depressed portions, at least one support member, and a sheet. The sheet is removably installed between the support member and the coupling rod. At least at one end portion of the sheet, the sheet includes a plurality of inserted portions along a width direction of the sheet. A flat plate is passed through at least one of the inserted portions. The support member with a flat intermediate portion is passed through another one of the inserted portions. The sheet is wound around outer peripheries of the inserted portion through which the plate is passed and the inserted portion through which the support member is passed to adjust a length of the sheet. In such state, the support member has both end portions fitted to the depressed portions on the frames.

8 Claims, 17 Drawing Sheets

(51) Int. Cl.

| | |
|---|---|
| ***A47D 13/10*** | (2006.01) |
| ***A47D 1/08*** | (2006.01) |
| ***A47D 1/04*** | (2006.01) |
| ***A47C 7/14*** | (2006.01) |
| ***A47D 1/00*** | (2006.01) |
| ***A47C 4/03*** | (2006.01) |
| ***A47C 4/32*** | (2006.01) |
| ***A47C 4/42*** | (2006.01) |
| ***A47C 7/00*** | (2006.01) |
| ***A47C 13/00*** | (2006.01) |
| ***A47C 16/02*** | (2006.01) |

(52) U.S. Cl.

CPC ..... *A47D 1/0085* (2017.05); *A47D 1/04* (2013.01); *A47D 1/08* (2013.01); *A47D 13/102* (2013.01); *A47D 15/006* (2013.01)

(56) References Cited

FOREIGN PATENT DOCUMENTS

| | | |
|---|---|---|
| JP | 2007-330330 | 12/2007 |
| JP | 2012-205616 | 10/2012 |
| WO | 2015/015590 | 2/2015 |

* cited by examiner

READY-TO-ASSEMBLE CHAIR

This application is a Continuation of International Application No. PCT/JP2015/064984, filed on May 26, 2015, the disclosure of which is incorporated by reference herein in its entirety.

BACKGROUND OF INVENTION

Technical Field

The disclosure relates to a ready-to-assemble chair (assembly chair) and, in further detail, relates to an assembly chair that can be widely and comfortably used by men and women of all ages, such as babies, infants, children, and adults.

Background Art

Conventionally, there has been proposed an assembly chair as described above that includes a pair of frames, a plurality of coupling rods removably mounted between these pair of frames, a backrest plate and a seat plate removably installed between these pair of frames in a predetermined manner, and a safety member such as a fall prevention member and a topple prevention member (for example, see Japanese Laid-Open Patent Publication No. 2006-68498). As another assembly chair, there has been proposed an assembly chair that includes a pair of frames, a plurality of coupling rods and a frame body removably mounted between these pair of frames, a sheet removably installed to this frame body in a predetermined manner, and a safety member such as a fall prevention member and a topple prevention member (for example, see Japanese Laid-Open Patent Publication No. 2012-205616).

However, in the conventional assembly chair like Japanese Laid-Open Patent Publication No. 2006-68498, since the backrest plate and the seat plate are made of a hard material such as a wood and a plastic, the assembly chair is not suitable for babies who do not have sufficient control over their necks and waists. The assembly chair also has a problem that cannot be used as a rocking chair. Additionally, the conventional assembly chair like Japanese Laid-Open Patent Publication No. 2012-205616 is originally manufactured for babies and infants and therefore is not suitable for adults. Further, while the assembly chair is advantageous in application for a plurality of usages, the assembly chair has a problem that a plurality of sheets with different lengths need to be prepared according to the usage.

In contrast to the conventional assembly chairs like Japanese Laid-Open Patent Publication No. 2006-68498 and No. 2012-205616, there has been proposed an assembly chair that can be widely used for men and women of all ages such as babies, infants, children, and adults. Further, the length of the sheet of the assembly chair can be changed according to the usage. Therefore, it is only necessary to prepare one sheet (see International Publication No. 2015/015590).

However, to change the length of the sheet according to the usage, the conventional assembly chair like International Publication No. 2015/015590 requires the following work. Support rods are passed through tubular portions formed at end portions of the sheet. Other support rods are attached to these support rods, and in this state, the sheet is wound around outer peripheries of these support rods such that the two support rods are not displaced and moved. In such a state, both end portions of the two support rods are aligned and are fitted to depressed portions on a pair of frames. This work is truly bothered and therefore becomes a problem.

SUMMARY

A problem to be solved by the disclosure is to provide an assembly chair that can be widely and comfortably used by men and women of all ages, such as babies, infants, children, and adults and the assembly chair for which it is only necessary to prepare one sheet. Further, the length of the sheet of the assembly chair can be changed in relationship with the usage by a simple work.

The disclosure to solve the problems is an assembly chair that includes a pair of frames, a plurality of coupling rods, a plurality of pairs of depressed portions, at least one support member, and a sheet. The pair of frames include respective linear side portions and curved side portions. The curved side portions are integrally disposed to extend from one end portions of the linear side portions. The plurality of coupling rods are removably mounted between the pair of frames. The plurality of pairs of depressed portions are disposed at opposed inner surfaces of the pair of frames. The at least one support member is removably mounted between the pair of frames with both end portions of the support member fitted to the depressed portions. The sheet is removably installed in a predetermined manner between the support member and the coupling rod or another support member between the pair of frames. At least at one end portion of the sheet, the sheet includes a plurality of insertion portions along a width direction of the sheet. A flat plate is passed through at least one of the insertion portions. The support member with a flat intermediate portion is passed through another one of the insertion portions. The sheet is wound around outer peripheries of the insertion portion through which the plate is passed and the insertion portion through which the support member is passed to adjust a length of the sheet. Both the end portions of the support member, in such a state, are fitted to the depressed portions on the frames for mounting.

The assembly chair according to the disclosure includes a pair of frames, a plurality of coupling rods, a plurality of pairs of depressed portions, at least one support member, and a sheet. The pair of frames include respective linear side portions and curved side portions. The curved side portions are integrally disposed to extend from one end portions of the linear side portions. The plurality of coupling rods are removably mounted between the pair of frames. The plurality of pairs of depressed portions are disposed at opposed inner surfaces of the pair of frames. The at least one support member is removably mounted between the pair of frames with both end portions of the support member fitted to the depressed portions. The sheet is removably installed in a predetermined manner between the support member and the coupling rod or another support member between the pair of frames. As details will be described later, the assembly chair according to the disclosure can be used, for example, as a usual chair when the linear side portions of the pair of frames are placed on the floor. Additionally, the assembly chair can be used, for example, as a rocking chair when the curved side portions of the pair of frames are placed on the floor.

At least at one end portion of the sheet, the plurality of insertion portions are formed along the width direction of the sheet. The flat plate is passed through at least one of the insertion portions. The support member with the flat intermediate portion is passed through another one of the insertion portions. The sheet is wound around the outer peripheries of the insertion portion through which the plate is passed and the insertion portion through which the support member is passed to adjust the length of the sheet. Both the end portions of the support member, in such a state, are fitted to the depressed portions on the frames for mounting.

The coupling rod can have any shape. For the coupling rod, usually a rod material with a circular, oval, or polygonal cross-sectional surface is used. Meanwhile, the plate has a flat shape, for example, a comparatively thin flat plate shape. The support member has the flat intermediate portion similar to the plate. For example, the support member is formed into a flat plate shape with intermediate portion narrowing down at one site or two sites, is thicker than the plate as a whole, and has both end portions with an oval or polygonal cross-sectional surface. The depressed portions disposed at the opposed inner surfaces of the pair of frames have a shape matching both the end portions of the support member and preferably a shape further matching the shape of both the end portions of the coupling rod. For example, with both the end portions of the support member having the oval cross-sectional surface, the depressed portions are also configured to have the oval cross-sectional surface so as to be fittable to both the end portions. With both the end portions of the support member having the polygonal cross-sectional surface, the depressed portions are also configured to have the polygonal cross-sectional surface so as to be fittable to both the end portions. Preferably, the relationship between the shape of both the end portions of the coupling rod and the shape of the depressed portions is similarly configured.

Both the end portions of the support member are fitted to the depressed portions and are screwed as necessary. Therefore, the length of the support member is slightly longer than the length of the sheet in the width direction. Similarly, the length of the coupling rod is slightly longer than the length of the sheet in the width direction. Meanwhile, the plate has the length equivalent to or slightly shorter than the length of the sheet in the width direction. Among the plurality of insertion portions formed along the width direction of the sheet at least at the one end portion of the sheet, the insertion portion through which the support member is passed has a tubular shape and the insertion portion through which the plate is passed has a tubular shape or a bag shape.

At the one end portion of the sheet, the plate is passed through at least the one insertion portion among the plurality of insertion portions formed along the width direction of the sheet. The support member is passed through another one insertion portion. The sheet is wound around the outer peripheries of the insertion portion through which the plate is passed and the insertion portion through which the support member is passed. In this state, both the end portions of the support member are fitted to the opposed depressed portions on the pair of frames. Then, the support member is fixed together with the plate. Similarly, at the other end portion of the sheet, both the end portions of the support member are fitted to the depressed portions for fixation or, alternatively, the coupling rod is passed through the insertion portion and both the end portions are fitted to the depressed portions for fixation at the other end portion of the sheet. Consequently, the length-adjusted sheet is fixed as well.

Even if a weight is applied to the sheet during the use of the sheet, the support members two in total or the one support member and the one coupling rod at both the end portions of the sheet are not moved from the pair of frames, and further, the sheet does not loosen. As details will be described later, to which positions on the frames of the depressed portions that the support member is fitted is selectable according to the usage such as the use as the usual chair for babies and infants, the use as the usual chair for adults, and further the use as the rocking chair for babies and infants. The number of the sheet may be one and further the length of the sheet can be easily adjusted. For the sheet, it can be made of a cloth, a net, or a similar material is available. It is also available for the sheet, for example, a sheet with a bag-shaped portion into which a self-supporting member such as a plate material and a cushion material is insertable at a part corresponding to the seated surface when the sheet is used as the chair.

The assembly chair according to the disclosure can be also configured as follows. The plurality of insertion portions are each formed along the width direction of the sheet at both end portions of the sheet. The flat plate is passed through at least one of the insertion portions. The support member with the flat intermediate portion is passed through another one of the insertion portions. The sheet is wound around the outer peripheries of the insertion portion through which the plate is passed and the insertion portion through which the support member is passed to adjust the length of the sheet. Both the end portions of the support member in such a state are fitted to the depressed portions of the pair of frames for mounting.

While it is only necessary that the number of insertion portions formed at the end portion of the sheet is plural, specifically two or more, three in total is preferable. In this case, the flat plates are passed through the insertion portions on both outer sides, the support member with the flat intermediate portion is passed through the insertion portion on the middle side, and the sheet is wound around the outer peripheries of the insertion portions through which the plates are passed and the insertion portion through which the support member is passed to adjust the length of the sheet. In such a state, both the end portions of the support member are fitted to the depressed portions on the pair of frames for mounting.

With the assembly chair according to the disclosure a crotch belt and thriller a shoulder belt are removably mounted to the sheet preferably. This reason is that, when a baby or an infant uses the assembly chair according to the disclosure, this configuration avoids a danger that the baby or the infant carelessly moves and falls off from the chair.

With the assembly chair according to the disclosure, stoppers for prevention of a topple in a front-rear direction are preferably disposed at the respective one end portions of the pair of frames where the curved side portions are integrally disposed to extend to the linear side portions. Additionally, stoppers for prevention of a topple in a right-left direction are removably mounted to the respective linear side portions of the pair of frames preferably. These stoppers ensure avoiding the chair in use to topple in the front-rear direction and the right-left direction. Similar to the support member and the coupling rod, both end portions of the footrest are removably mounted to the opposed inner surfaces of the curved side portions of the pair of frames. At this time, when the front surface portion of the footrest projects to the front surface side (the front side) with respect to the curved side portions, as details will be described later, the front surface portion of the footrest functions as the stopper for prevention of the topple in the case where the assembly chair according to the disclosure is used as the rocking chair.

Additionally, with the assembly chair according to the disclosure, the following is preferable. A pair of line grooves are disposed so as to be open at opposed inner surfaces of the curved side portions of the pair of frames. Frames disposed to extend from both end portions of a table are removably and slidably fitted to the pair of line grooves. This reason is that, this configuration is truly convenient for eating and drinking, especially eating and drinking by babies and infants.

Since the assembly chair according to the embodiment includes the backrest surface and the sheeted surface made of the sheet, usually the sheet made of the cloth and the net, the assembly chair can be used for babies who do not have sufficient control over their necks and waists and can also be used as the rocking chair. Further, only one sheet is necessary for forming the backrest surface and the sheeted surface, therefore, the length can be adjusted by the simple work. The assembly chair according to the embodiment can be widely and comfortably used by men and women of all ages, such as babies, infants, children, and adults.

EMBODIMENTS

Figure 1:
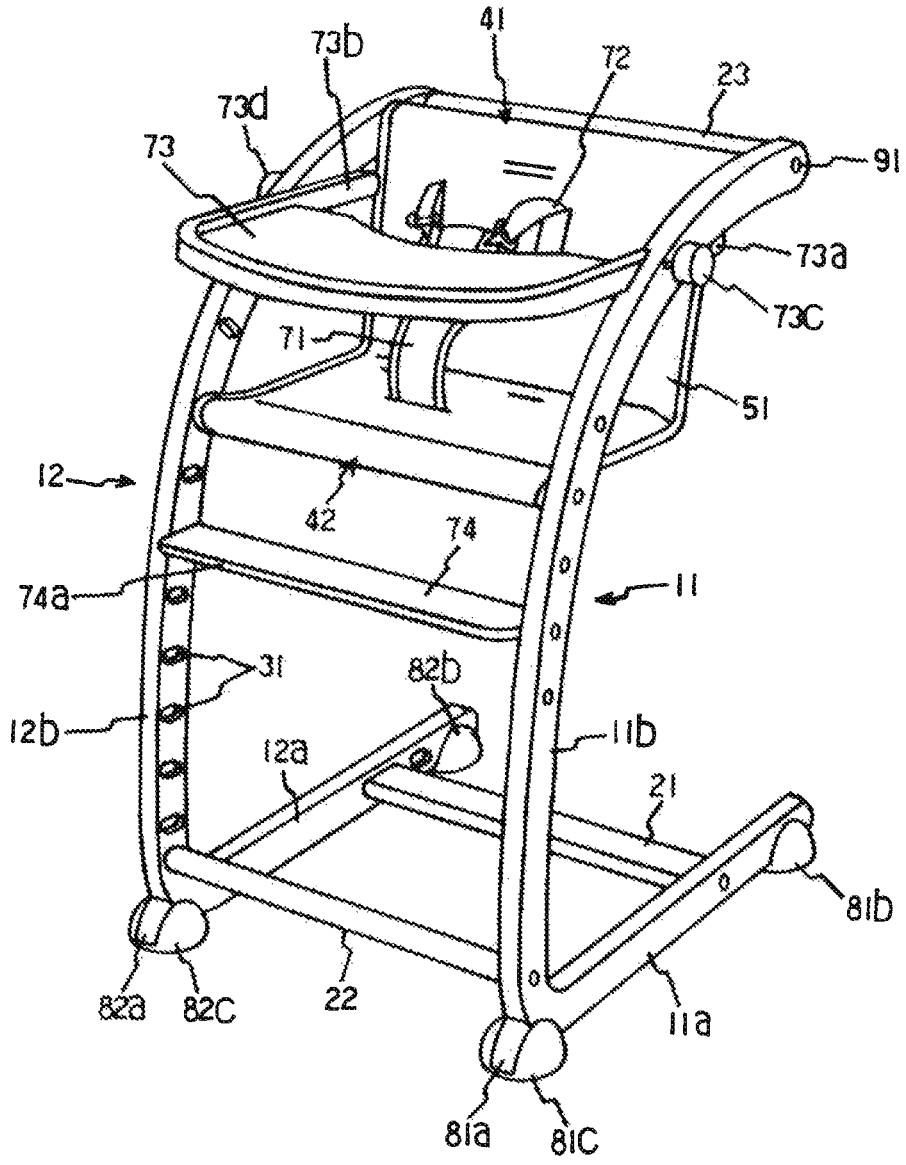
FIG. 1 is an overall perspective view illustrating an example of an assembly chair according to the disclosure.

FIG. 1 is an overall perspective view illustrating an example of a assembly chair according to the disclosure. The assembly chair illustrated in FIG. 1 as the example illustrates the case where linear side portions 11*a* and 12*a* of a pair of frames 11 and 12 are placed on a floor for use as a usual chair mainly for babies and infants as the example. The assembly chair illustrated in FIG. 1 as the example includes the pair of frames 11 and 12, a plurality of coupling rods 21 to 23, a plurality of pairs of depressed portions 31, 31 . . . , support member 41 and 42, and a sheet 51. The pair of frames 11 and 12 include the respective linear side portions 11*a* and 12*a* and curved side portions 11*b* and 12*b*, which are integrally disposed to extend from one end portions of the linear side portions 11*a* and 12*a*. The coupling rods 21 to 23 are removably mounted between the pair of frames 11 and 12. The depressed portions 31, 31 . . . are disposed at opposed inner surfaces of the pair of frames 11 and 12. Both end portions of the support member 41 and 42 are fitted to the depressed portions 31, 31 . . . . The sheet 51 is removably installed in a predetermined manner between the one support member 41 and the other support member 42 between the pair of frames 11 and 12.

Insertion portions 61 to 63 three in total are formed in parallel in a lateral direction along a width direction of the sheet 51 at one end portion (the upper end portion) of the sheet 51. The insertion portions 61 and 62 are formed into a bag shape, and the insertion portion 63 is formed into a tubular shape. Flat plates 41*a* and 41*b* are passed through the insertion portions 61 and 62 on both outer sides, and the support member 41 is passed through the insertion portion 63 on the middle side. At the one end portion of the sheet 51, the sheet 51 is wound around the outer peripheries of the insertion portions 61 and 62 through which the plates 41*a* and 41*b* are passed and the insertion portion 63 through which the support member 41 is passed to adjust the length of the sheet 51. In such a state, both end portions of the support member 41 are fitted to the depressed portions 31 and 31 on the pair of frames 11 and 12. Although the explanation is omitted, the other end portion (the lower end portion) of the sheet 51 also has the similar configuration.

In the assembly chair according to the disclosure illustrated in FIG. 1 as the example, a crotch belt 71 and a shoulder belt 72 are removably mounted to the approximately center of the sheet 51. Claw-shaped stoppers 81*a* and 82*a* are disposed to protrude forward for prevention of a topple in the front-rear direction at the one end portions of the pair of frames 11 and 12 where the curved side portions 11*b* and 12*b* are integrally disposed to extend to the respective linear side portions 11*a* and 12*a*. Further, stoppers 81*b*, 81*c*, 82*b*, and 82*c* for prevention of the topple in the right-left direction are removably mounted to respective both end portions of the linear side portions 11*a* and 12*a* of the pair of frames 11 and 12. Further, a pair of line grooves 11*c* and 12*c* are disposed so as to be open at the opposed inner surfaces of the pair of frames 11 and 12. Frame members 73*a* and 73*b*, which are disposed to extend from both end portions of a table 73, are removably and slidably fitted to the pair of line grooves 11*c* and 12*c*. Both end portions of a footrest 74 are fitted to the depressed portions 31 and 31 on the pair of frames 11 and 12. A front surface portion 74*a* of the footrest 74 projects to the front surface side (the front side) with respect to the curved side portions 11*b* and 12*b* of the pair of frames 11 and 12.

Figure 2:
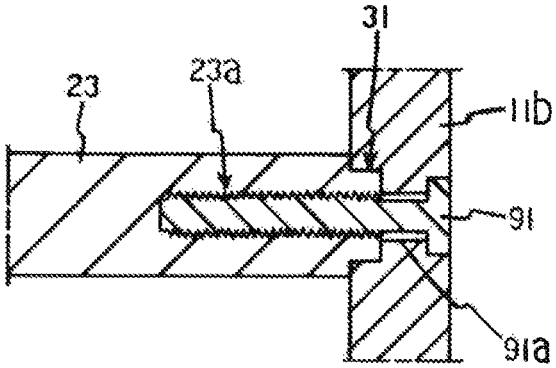
FIG. 2 illustrates a partially enlarged cross-sectional view viewing a state where a coupling rod is mounted to a depressed portion on a frame in the assembly chair in FIG. 1 in a front view.

FIG. 2 illustrates a partially enlarged cross-sectional view viewing a state where the coupling rod is mounted to the frame in the assembly chair in FIG. 1 in a front view. The cross-sectional surface of the one end portion of the coupling rod 23 and the cross-sectional surface of the depressed portion 31 disposed at the inner surface of the curved side portion 11*b* of the frame 11 are both formed into a flat elliptical shape. The one end portion of the coupling rod 23 is fitted to the depressed portion 31 on the curved side portion 11*b*. A hole 91*a* is drilled at the curved side portion 11*b* facing the depressed portion 31, and a screw groove 23*a* is disposed at the central axis line portion at the one end portion of the coupling rod 23. By screwing a screw 91 into the screw groove 23*a* through the hole 91*a* for fastening, the one end portion of the coupling rod 23 is removably mounted to the depressed portion 31 on the curved side portion 11*b*. Although the explanation is omitted, the other end portion of the coupling rod 23 has the similar relationship with the depressed portion 31 on the curved side portion 12*b*. These relationships are also similar to the other coupling rods 21 and 22.

Figure 3:
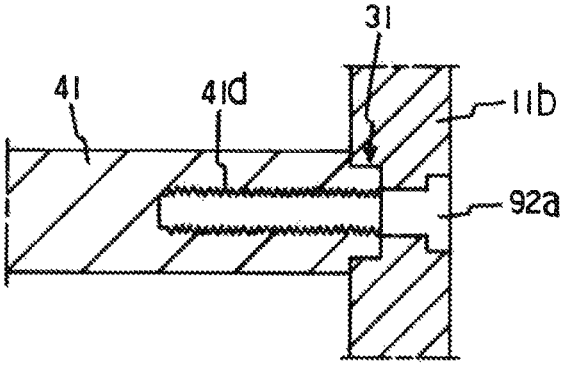
FIG. 3 illustrates a partially enlarged cross-sectional view viewing a state where the support member is mounted to the depressed portion on the frame in the assembly chair in FIG. 1 in the front view.

FIG. 3 illustrates a partially enlarged cross-sectional view viewing a state where the support member is mounted to the frame in the assembly chair in FIG. 1 in the front view. The cross-sectional surface of the one end portion of the support member 41 and the cross-sectional surface of the depressed portion 31 disposed at the inner surface of the curved side portion 11*b* of the frame 11 are both formed into a flat elliptical shape, and the one end portion of the support member 41 is fitted to the depressed portion 31 on the curved side portion 11*b*. A hole 92*a* is drilled at the curved side portion 11*b* facing the depressed portion 31, and a screw groove 41*d* is disposed at the central axis line portion at the one end portion of the support member 41. A screw (not illustrated) is passed through the hole 92*a* and screwed with the screw groove 41*d* for ensuring fastening. Meanwhile, in the case as illustrated in the drawing, only the fitting as described above makes the one end portion of the support member 41 removably mount to the depressed portion 31 on the curved side portion 11*b*. Although the explanation is omitted, the other end portion of the support member 41 has the similar relationship with the depressed portion 31 on the curved side portion 12*b*. These relationships are also similar to the other support member 42.

Figure 4:
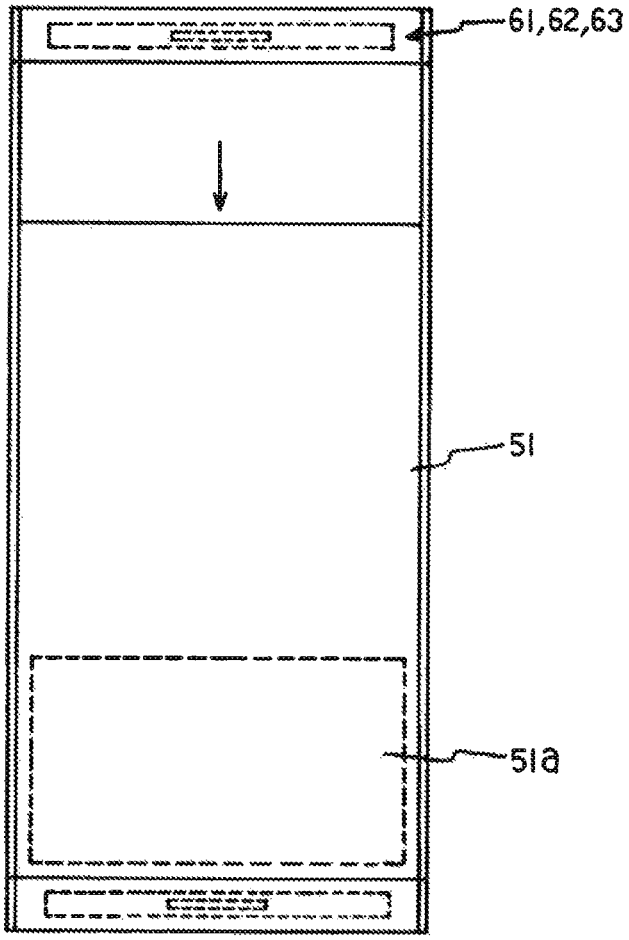
FIG. 4 is a development diagram illustrating a sheet used for the assembly chair in FIG. 1.
Figure 5:
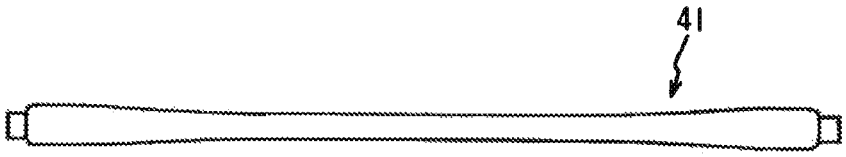
FIG. 5 is an enlarged front view illustrating the support member used for the assembly chair in FIG. 1.
Figure 6:
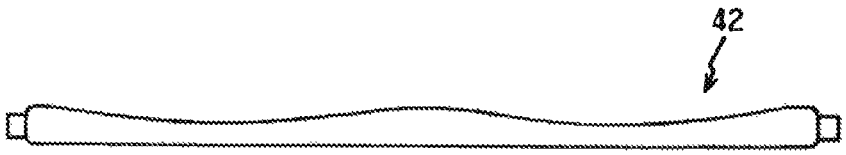
FIG. 6 is an enlarged front view illustrating another support member used for the assembly chair in FIG. 1.

FIG. 4 is a development diagram illustrating the sheet used for the assembly chair in FIG. 1. FIG. 5 and FIG. 6 are enlarged front views illustrating the support members used for the assembly chair in FIG. 1. The sheet 51 is formed into a rectangular shape as a whole, and, as the details will be described later, the insertion portions three in total are formed along the width direction at respective both end portions in the longitudinal direction of the sheet 51. The intermediate portion is formed into the double bag shape such that a cushion plate 51*a* for a seated surface and a cushion plate for backrest (not illustrated) can be housed. The support member 41 is to be passed through the insertion portion at the one end portion (the upper end portion) of the sheet 51. The support member 41 has a flat shape as a whole whose intermediate portion gradually narrows down, and has protrusions having an oval cross-sectional surface fitting to the depressed portions 31, 31 . . . on the frames 11 and 12 at both end portions. On the other hand, the support member 42 is to be passed through the insertion portion at the other end portion (the lower end portion) of the sheet 51. The support member 42 has a flat shape as a whole whose intermediate portions gradually narrow down at two sites, and has protrusions having an oval cross-sectional surface fitting to the depressed portions 31, 31 . . . on the frames 11 and 12 at both end portions.

Figure 7:
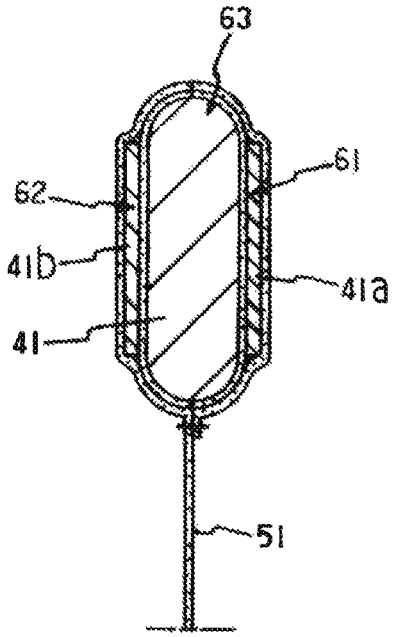
FIG. 7 is a partially enlarged cross-sectional view illustrating a state immediately before the sheet is wound around outer peripheries of an insertion portion through which the support member is passed and insertion portions through which plates are passed at one end portion of the sheet of the assembly chair in FIG. 1.
Figure 8:
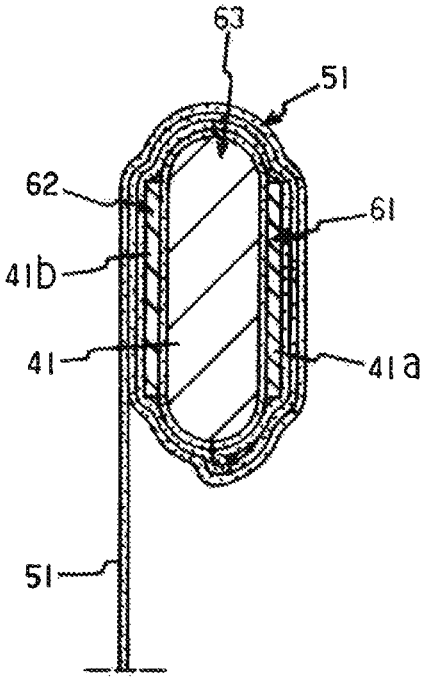
FIG. 8 is a partially enlarged cross-sectional view illustrating a state after the sheet is wound around the outer peripheries of the insertion portion through which the support member is passed and the insertion portions through which the plates are passed from the state in FIG. 7.

FIG. 7 is a partially enlarged cross-sectional view illustrating a state immediately before the sheet is wound around the outer peripheries of the insertion portion through which the support member is passed and the insertion portions through which the plates are passed at the one end portion of the sheet of the assembly chair in FIG. 1. FIG. 8 is a partially enlarged cross-sectional view illustrating a state after the sheet is wound around the outer peripheries of the insertion portion through which the support member is passed and the insertion portions through which the plates are passed from the state in FIG. 7. In FIG. 7, the insertion portions 61 to 63 three in total are formed in parallel in the lateral direction along the width direction of the sheet 51 at the one end portion (the upper end portion) of the sheet 51. The insertion portions 61 and 62 are formed into the bag shape, and the insertion portion 63 is formed into the tubular shape. The flat plates 41*a* and 41*b* are passed through the insertion portions 61 and 62 on both outer sides, and the support member 41 is passed through the insertion portion 63 on the middle side. In FIG. 8, at the one end portion of the sheet 51, the sheet 51 is wound around the outer peripheries of the insertion portions 61 and 62 through which the plates 41*a* and 41*b* are passed and the insertion portion 63 through which the support member 41 is passed to adjust the length of the sheet 51. In such a state, both end portions of the support member 41 are fitted to the depressed portions 31 and 31 on the pair of frames 11 and 12. Although the explanation is omitted, the other end portion (the lower end portion) of the sheet 51 also has the similar configuration except that the support member 41 is replaced by the support member 42.

In the actual procedure, for example, the screws 91 and 92 (note that the screw 92 is not illustrated, and the same applies to the following) in the coupling rod 23 are loosened to remove the support member 41 from the depressed portions 31, 31 . . . , and the end portion of the sheet 51 is wound around the outer peripheries of the insertion portion 63 through which the support member 41 is passed and the insertion portions 61 and 62 through which the plates 41*a* and 41*b* are passed in accordance with the above-described procedure for FIG. 7 and FIG. 8 to adjust the length. Again, the screws 91 and 92 are fastened while both end portions of the support member 41 are fixed up to the appropriately selected depressed portions 31, 31 . . . to fit both end portions of the support member 41 to the depressed portions 31, 31 . . . , and the length-adjusted sheet 51 is removably installed between the one support member 41 and the other support member 42 in a predetermined manner.

Figure 9:
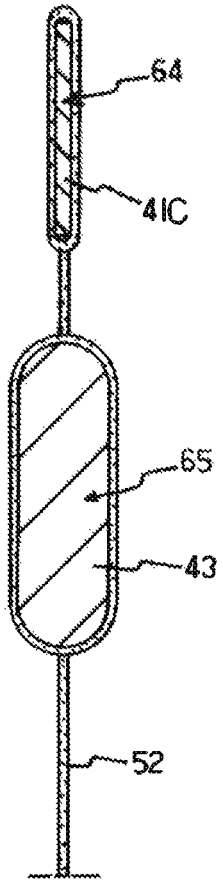
FIG. 9 is a partially enlarged cross-sectional view illustrating a state immediately before a sheet is wound around outer peripheries of an insertion portion through which a support member is passed and an insertion portion through which a plate is passed at one end portion of the sheet of another assembly chair according to the disclosure.
Figure 10:
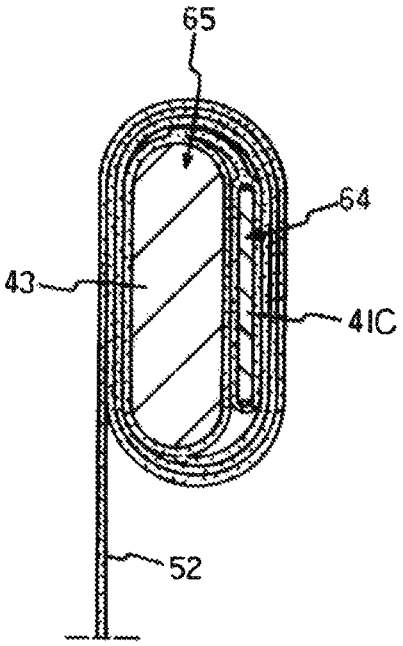
FIG. 10 is a partially enlarged cross-sectional view illustrating a state after the sheet is wound around the outer peripheries of the insertion portion through which the support member is passed and the insertion portion through which the plate is passed from the state in FIG. 9.

FIG. 9 is a partially enlarged cross-sectional view illustrating a state immediately before a sheet is wound around outer peripheries of an insertion portion through which a support member is passed and an insertion portion through which a plate is passed at one end portion of the sheet of another assembly chair. FIG. 10 is a partially enlarged cross-sectional view illustrating a state after the sheet is wound around the outer peripheries of the insertion portion through which the support member is passed and the insertion portion through which the plate is passed from the state in FIG. 9. In FIG. 9, insertion portions 64 and 65 two in total are formed in parallel in a vertical direction along a width direction of a sheet 52 at one end portion (the upper end portion) of the sheet 52. The insertion portion 64 is formed into a bag shape, and the insertion portion 65 is formed into the tubular shape. A flat plate 41*c* is passed through the insertion portion 64 on the outer side, and a support member 43 is passed through the insertion portion 65 on the middle side. In FIG. 10, at the one end portion of the sheet 52, the sheet 52 is wound around the outer peripheries of the insertion portion 64 through which the plate 41*c* is passed and the insertion portion 65 through which the support member 43 is passed to adjust the length of the sheet 52. In such a state, both end portions of a support member 43 are fitted to depressed portions on a pair of frames.

Figure 11:
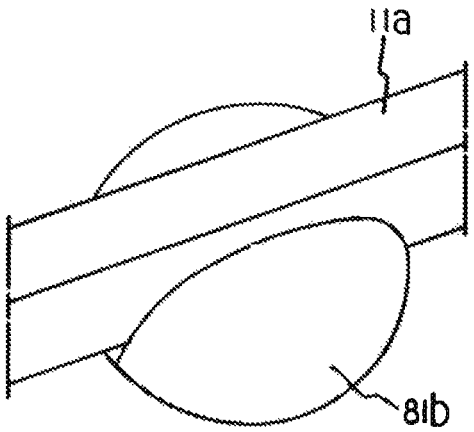
FIG. 11 is a partially enlarged perspective view illustrating a stopper for prevention of a topple in a right-left direction mounted to a linear side portion of the frame in the assembly chair in FIG. 1.

FIG. 11 is a partially enlarged perspective view illustrating a stopper for prevention of a topple in a right-left direction mounted to the linear side portion of the frame in the assembly chair in FIG. 1. A stopper 81*b* has a shape having a line groove at the center of a hemispherical body. The linear side portion 11*a* of the frame 11 is inserted into this line groove. Although explanations are omitted, the other stoppers 81*c*, 82*b*, and 82*c* are also similarly configured. These stoppers 81*b*, 81*c*, 82*b*, and 82*c* avoid the assembly chair to topple in the right-left direction during the use. The stoppers 81*a* and 82*a* have the claw shape as described above and are disposed to protrude forward at the one end portion where the curved side portions 11*b* and 12*b* are integrally disposed to extend from the linear side portions 11*a* and 12*a* of the pair of frames 11 and 12. This configuration avoids the assembly chair to topple in the front-rear direction during the use. As details will be described later, when the assembly chair is used as the rocking chair, the front surface portion 74*a*, which projects to the front surface side (the front side) of the footrest 74, functions as a stopper for prevention of an excessive topple of the rocking chair in the front-rear direction.

Figure 12:
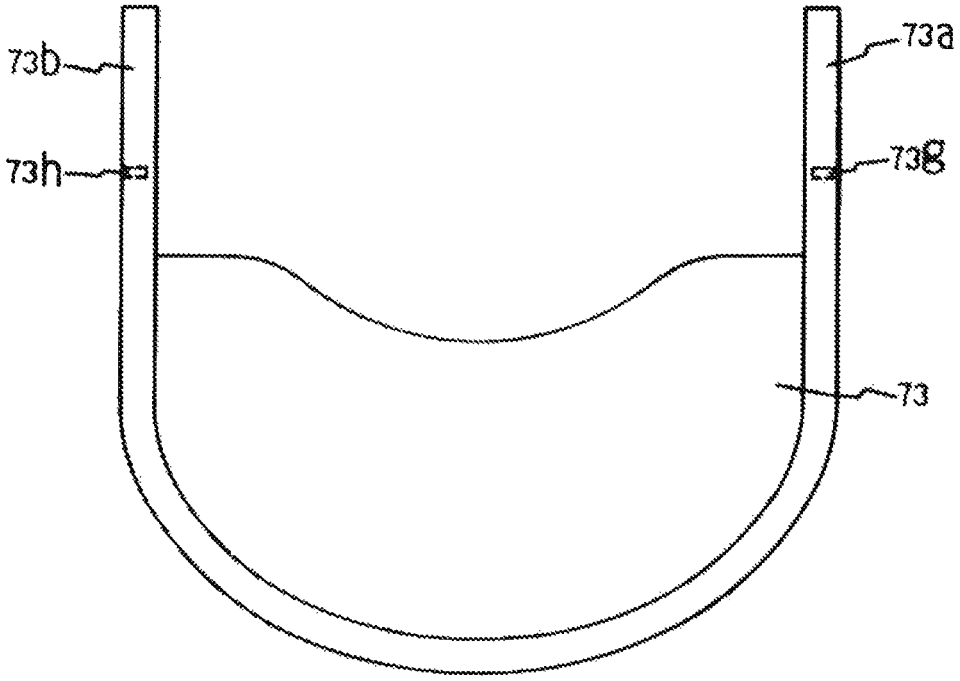
FIG. 12 is an enlarged plan view illustrating a table in the assembly chair in FIG. 1.
Figure 13:
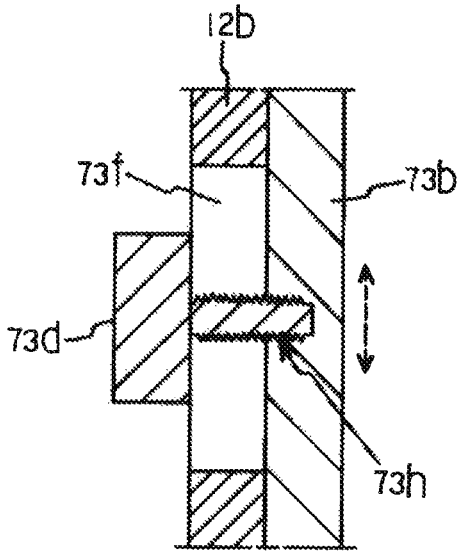
FIG. 13 is a partially enlarged cross-sectional view illustrating a state where frame members of the table in FIG. 12 are inserted into line grooves of the frames.
Figure 14:
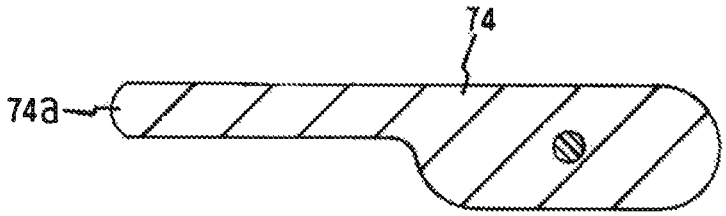
FIG. 14 is an enlarged cross-sectional view illustrating a footrest in the assembly chair in FIG. 1.

FIG. 12 is an enlarged plan view illustrating a table in the assembly chair in FIG. 1. FIG. 13 is a partially enlarged cross-sectional view illustrating a state where frame members of the table in FIG. 12 are slidably fitted to the line grooves of the frames. The table 73 includes a center placement table and frame members 73*a* and 73*b* of the placement table, and end portions of the frame members 73*a* and 73*b* are disposed to extend rearward from the placement table. The line grooves 11*c* and 12*c* corresponding to the frame members 73*a* and 73*b* are disposed at the opposed inner surfaces of the curved side portions 11*b* and 12*b* of the pair of frames 11 and 12. Slits 73*e* and 73*f* are drilled at the curved side portions 11*b* and 12*b* facing the line grooves 11*c* and 12*c*. Screw grooves 73*g* and 73*h* are provided on the frame members 73*a* and 73*b*. The frame members 73*a* and 73*b* are inserted into the line grooves, and screws 73*c* and 73*d* are screwed with the screw grooves 73*g* and 73*h* through the slits for fastening. Thus, the table 73 is removably mounted to the curved side portions 11*b* and 12*b* of the pair of frames 11 and 12.

Figure 15:
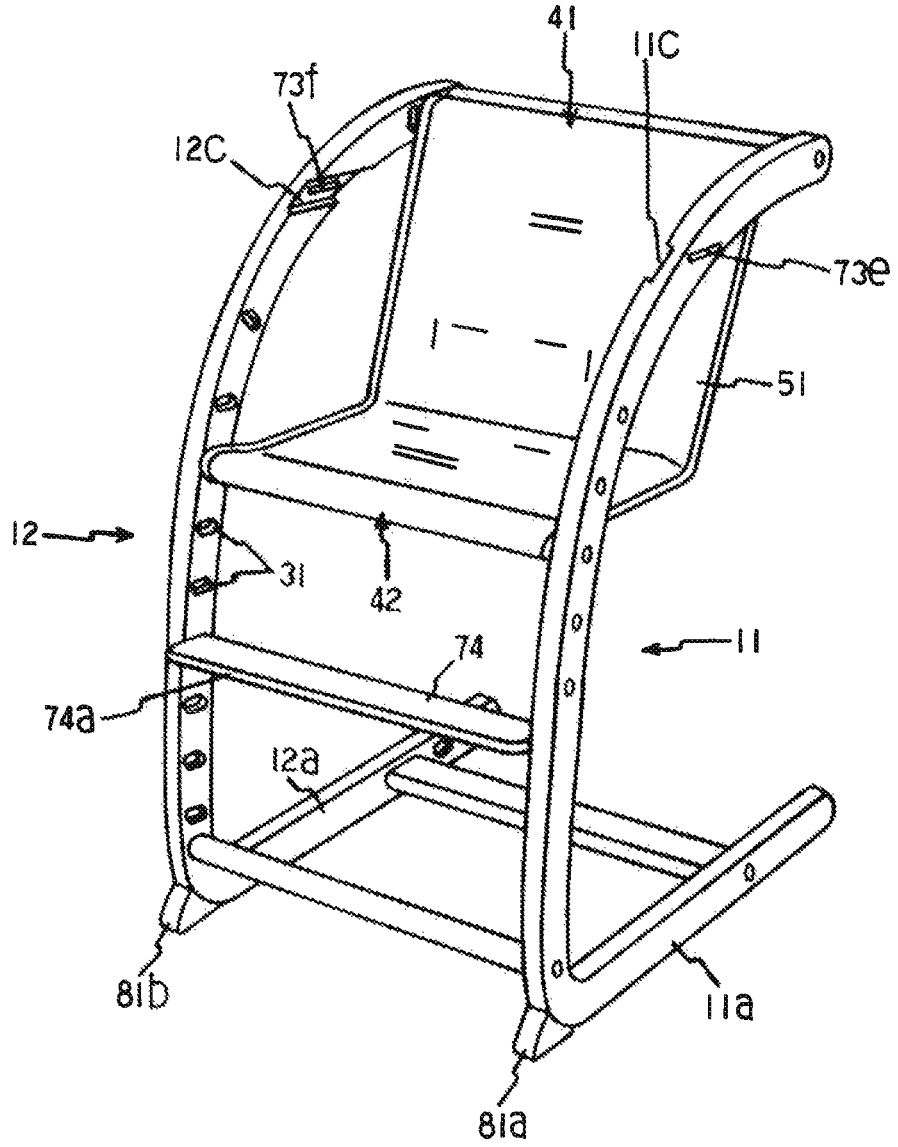
FIG. 15 is an overall perspective view illustrating an example of another usage state of the assembly chair in FIG. 1.

FIG. 15 is an overall perspective view illustrating an example of another usage state of the assembly chair in FIG. 1. Similar to the assembly chair in FIG. 1 the assembly chair illustrated in FIG. 15 as the example illustrates the case where the linear side portions 11*a* and 12*a* of the pair of frames 11 and 12 are placed on the floor for use as the usual chair as the example. Meanwhile, FIG. 15 illustrates the case where the length of the sheet 51 is adjusted longer than the length in FIG. 1, the positions of the depressed portions 31 and 31, which are fitted to both end portions of the support member 42, are lowered compared with the positions in FIG. 1, and a crotch belt 71 and a table 73 are removed for use as a usual chair mainly for adults as the example.

Figure 16:
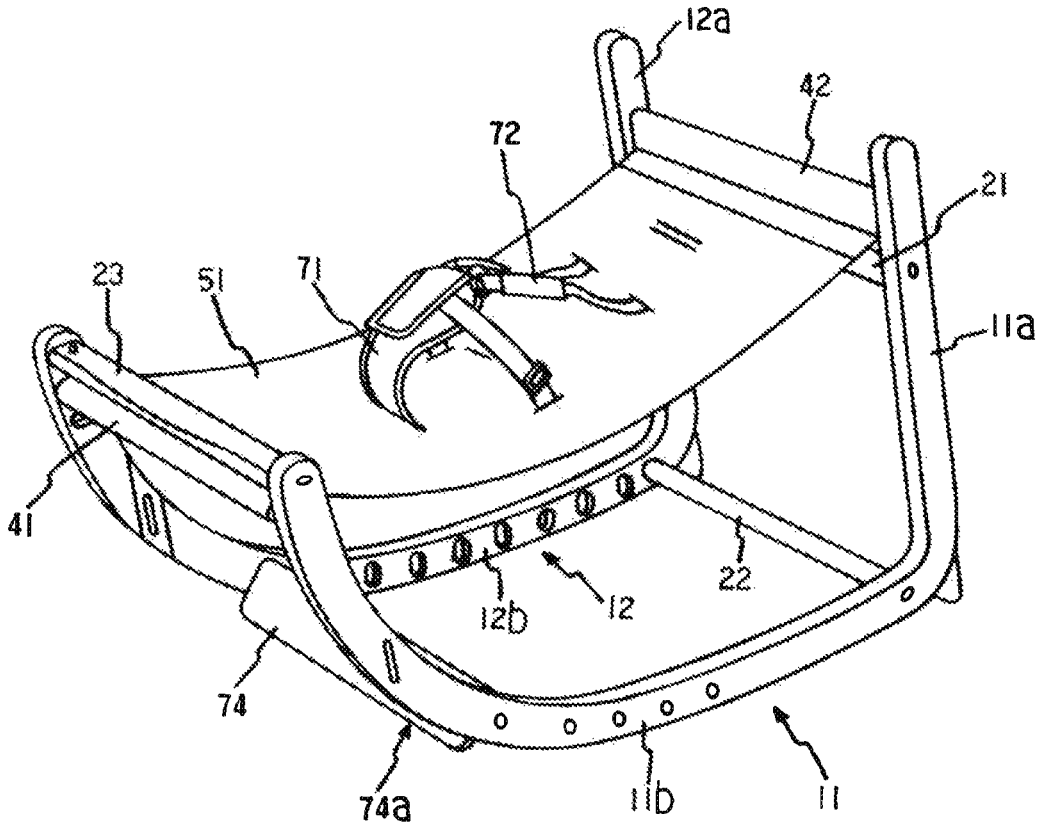
FIG. 16 is an overall perspective view illustrating an example of yet another usage state of the assembly chair in FIG. 1.

FIG. 16 is an overall perspective view illustrating an example of yet another usage state of the assembly chair in FIG. 1. Different from the assembly chairs in FIG. 1 and FIG. 15, FIG. 16 illustrates the assembly chair where the curved side portions 11*b* and 12*b* of the pair of frames 11 and 12 are placed on the floor for use as the rocking chair mainly for babies and infants as the example. In the assembly chair in FIG. 16, the length of the sheet 51 is adjusted longer than the length in FIG. 1 and FIG. 15, the table 73 is removed, and the front surface portion (the lower surface portion in FIG. 16) 74*a*, which projects with respect to the curved side portions 11*b* and 12*b*, of the footrest 74 functions as a stopper for prevention of the excessive topple of the rocking chair in the front-rear direction.

Figure 17:
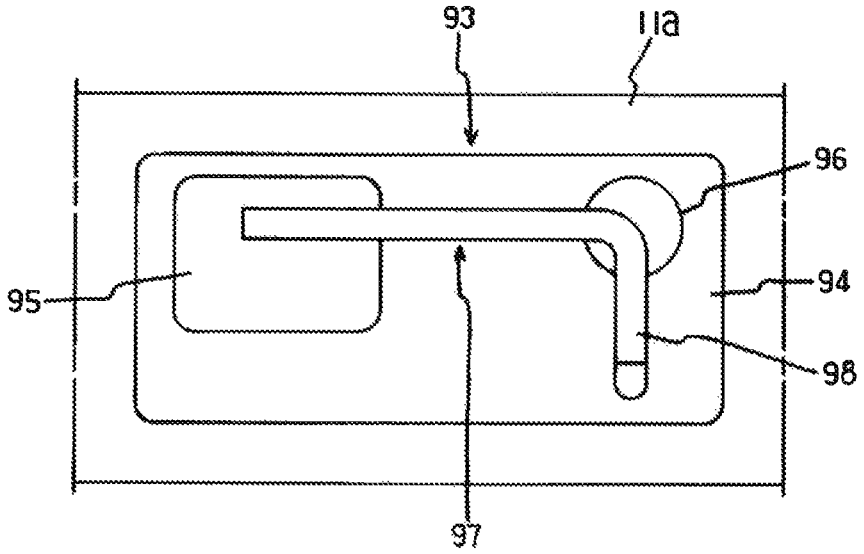
FIG. 17 is a partially enlarged bottom view illustrating the assembly chair in FIG. 1.

FIG. 17 is a partially enlarged bottom view illustrating the assembly chair in FIG. 1. A depressed portion 93 having a rectangular parallelepiped shape as a whole is formed on the bottom surface of the linear side portion 11*a* of the frame 11, and an elastic body 94 having a rectangular parallelepiped shape as a whole is fitted to the depressed portion 93. The elastic body 94 includes an L-shaped line groove 97 having slightly larger void portions 95 and 96 at two sites. A hexagonal wrench 98 for the screw 91 is engaged with the line groove 97 to prevent a loss of a tool required for assembly and disassembly of the assembly chair, the hexagonal wrench in this case.

It is explicitly stated that all features disclosed in the description and/or the claims are intended to be disclosed separately and independently from each other for the purpose of original disclosure as well as for the purpose of restricting the claimed invention independent of the composition of the features in the embodiments and/or the claims. It is explicitly stated that all value ranges or indications of groups of entities disclose every possible intermediate value or intermediate entity for the purpose of original disclosure as well as for the purpose of restricting the claimed invention, in particular as limits of value ranges.

The invention claimed is:

1. An assembly chair comprising:

a pair of frames including respective linear side portions and curved side portions, each curved side portion being integrally disposed to extend from a front end portion of each linear side portion;

a plurality of coupling rods removably mounted between the pair of frames;

a plurality of pairs of depressed portions disposed at opposed inner surfaces of the pair of frames;

at least one support member removably mounted between the pair of frames with right and left end portions of the support member being fitted to selected ones of the depressed portions; and a sheet removably installed between the pair of frames, supported therebetween by the support member and at least one of the plurality of coupling rods, the sheet including at least an upper end portion, a lower end portion, a front outer side, and a rear outer side, wherein at least one end portion of the sheet includes a plurality of insertion portions defined within the sheet between the front outer side and the rear outer side along a width direction thereof, a first flat plate being passed through at least one of the insertion portions, and a flat intermediate portion of the support member being passed through another one of the insertion portions, the sheet being wound around outer peripheries of the insertion portion through which the plate is passed and the insertion portion through which the support member is passed to adjust a length of the sheet, and in such state, the support member having the right and left end portions fitted to the depressed portions of the frames.

2. The assembly chair according to claim 1, wherein:

the plurality of insertion portions are each formed along the width direction of the sheet at both outer sides of the sheet, the flat plate is passed through at least one of the insertion portions, the support member with the flat intermediate portion is passed through another one of the insertion portions, the sheet is wound around the outer peripheries of the insertion portion through which the plate is passed and the insertion portion through which the support member is passed to adjust the length of the sheet, and both the end portions of the support member, in such state, are fitted to the depressed portions of the pair of frames for mounting.

3. The assembly chair according to claim 1, wherein:

the first flat plate is passed through a first insertion portion on the front outer side of the at least one end portion of the sheet, a second flat plate is passed through a second insertion portion on the rear outer side of the at least one end portion of the sheet, the support member with the flat intermediate portion is passed through a third insertion portion intermediate the first and second insertion portions, and the sheet is wound around outer peripheries of the insertion portions through which the plates are passed and the insertion portion through which the support member is passed to adjust the length of the sheet.

4. The assembly chair according to claim 1, wherein a crotch belt and a shoulder belt are removably mounted to the sheet.

5. The assembly chair according to claim 1, further comprising stoppers for prevention of a topple in a front-rear direction disposed at least at intersections of lower end portions of the curved side portions and the respective front end portions of the linear side portions.

6. The assembly chair according to claim 1, further comprising stoppers for prevention of a topple in a right-left direction are removably mounted to the respective linear side portions of the pair of frames.

7. The assembly chair according to claim 1, further comprising a footrest removably mounted in a state where right and left end portions of the footrest are fitted to opposed inner surfaces of the curved side portions of the pair of frames and a front surface portion of the footrest projects with respect to the curved side portions.

8. The assembly chair according to claim 1, further comprising:

a pair of line grooves disposed so as to be open at opposed inner surfaces of the curved side portions of the pair of frames; and frame members disposed to extend from right and left end portions of a table removably and slidably fitted to the pair of line grooves for mounting the table to the curved side portions.

* * * * *